US006691529B2

(12) United States Patent
Sugie et al.

(10) Patent No.: US 6,691,529 B2
(45) Date of Patent: Feb. 17, 2004

(54) AUGER TYPE ICE-MAKING MACHINE

(75) Inventors: Hiroyuki Sugie, Tokai (JP); Mika Hamajima, Obu (JP); Akihiro Sato, Tokai (JP)

(73) Assignee: Hoshizaki Electric Co., Ltd., Tokyo (JP)

( * ) Notice: Subject to any disclaimer, the term of this patent is extended or adjusted under 35 U.S.C. 154(b) by 0 days.

(21) Appl. No.: 10/269,850

(22) Filed: Oct. 11, 2002

(65) Prior Publication Data

US 2003/0079489 A1 May 1, 2003

(30) Foreign Application Priority Data

Oct. 12, 2001 (JP) ..... P2001-315940

(51) Int. Cl.[7] ..... F25C 1/14
(52) U.S. Cl. ..... 62/354
(58) Field of Search ..... 62/354, 291

(56) References Cited

U.S. PATENT DOCUMENTS 3,276,223 A 10/1966 Lunde ..... 62/320

FOREIGN PATENT DOCUMENTS

JP 59-18363 1/1984 ..... F25C/1/14
JP 10-2645 1/1998 ..... F25C/1/14

OTHER PUBLICATIONS

Patent Abstracts of Japan, publication no. 10–002645, publication date Jan. 6, 1998.
Japanese Patent Office Gazette of Unexamined Patent Application; Patent Application Laid–Open (KOKAI) No. S59–18363; Laid–Open Date: Jan. 30, 1984.

*Primary Examiner*—William E. Tapolcai
(74) *Attorney, Agent, or Firm*—Rosenthal & Osha L.L.P.

(57) ABSTRACT

An auger type ice-making machine of the present invention comprises a tubular freezer casing which has an ice-making cylinder that rotatably accommodates an auger inside, an ice compression head which rotatably supports the upper end of the auger, a housing which rotatably supports the lower end of the auger, and a geared motor which is connected to the lower part of the housing. The geared motor drives the auger rotationally. And the auger type ice-making machine of the present invention further comprises a flange which constitutes an attachment base for the ice discharge tube attached to the upper part of the freezer casing. The flange is fastened to the ice-making cylinder by means of bolts that also fasten the ice compression head to the inside of the ice-making cylinder.

2 Claims, 11 Drawing Sheets

AUGER TYPE ICE-MAKING MACHINE

BACKGROUND OF THE INVENTION

1. Field of the Invention

The present invention relates to an auger type ice-making machine which manufactures chip-form or flake-form ice by freezing ice-making water that is supplied to the interior of a freezer casing while rotating an auger in the interior of this freezer casing via a geared motor.

2. Related Background Art

Various sorts of auger type ice-making machines have been proposed in the past (Japanese Patent Application Laid-Open No. H 10-2645 and Japanese Patent Application Laid-Open No S 59-18363). In such auger type ice-making machines, an auger (screw) is supported inside a tubular freezer casing between an ice compression head that is disposed above the freezer casing and a housing that is disposed below the freezer casing, so that this auger can rotate. Furthermore, while ice-making water that is supplied to the interior of the freezer casing is frozen, the auger rotates via a geared motor connected to the lower end of the auger inside the housing, so that sorbet-like ice produced by the freezing of this ice-making water is introduced into the ice compression head. This sorbet-like ice is compressed by the ice compression head to produce chip-form or flake-form ice.

An ice discharge tube which regulates the discharge direction of the manufactured ice is attached to the upper part of the freezer casing of such an auger type ice-making machine. This ice discharge tube is generally made of a resin, and is fastened by bolts or the like to a flange that is attached to the metal (stainless steel) ice-making cylinder that accommodates the auger. Specifically, this flange forms an attachment base for the ice discharge tube. The ice discharge tube needs to be fastened securely because a certain load is applied when being pushed by the ice that is compressed and discharged. For this reason, the flange that constitutes the attachment base for the ice discharge tube is generally fastened to the ice-making cylinder by welding.

However, if the flange is fastened directly to the ice-making cylinder by welding or brazing, sometimes as light strain is generated in the ice-making cylinder, and it is concerned that the rotation of the auger is impeded by an abnormal load or the like caused by the attachment of the internal ice compression head or variation in the ice film that is produced inside the ice-making cylinder. Furthermore, as welding or brazing processes themselves also involve extra effort, a considerable amount of labor is required in the flange fastening work. In addition, the portion of the ice-making cylinder that is located in the vicinity of the ice compression head is a location where a slight expansion and contraction are repeated, so that stress fluctuations are generated, and there are maintenance problems in that stripping of the welded portions or the like may occur as a result of such stress fluctuations, so that the flange falls off.

SUMMARY OF THE INVENTION

Accordingly, it is an object of the present invention to provide an auger type ice-making machine in which the fastening of the ice discharge tube can be accomplished in a simple manner, and wherein manufacture and maintenance of the ice-making machine are easy.

An auger type ice-making machine according to the present invention comprises a tubular freezer casing which has an ice-making cylinder that rotatably accommodates an auger inside, an ice compression head which rotatably supports the upper end of the auger, and which is disposed on the upper part of the freezer casing, a housing which rotatably supports the lower end of the auger, and which is disposed under the lower part of the freezer casing, a geared motor which is connected to the lower part of the housing, and which performs rotational driving of the auger. And the auger type ice-making machine according to the present further comprises a flange constituting an attachment base for an ice discharge tube that is attached to the upper part of the freezer casing. And, in the auger type ice-making machine according to the present, the flange is fastened to the ice-making cylinder by means of bolts that fasten the ice compression head to the interior of the ice-making cylinder.

It is preferable here that the flange has an outer cylinder in which through-holes for the bolts are formed, and a dew receiving dish that captures condensed water that is condensed in the vicinity of the bolts is connected to the outer cylinder.

DESCRIPTION OF THE PREFERRED EMBODIMENTS

Figure 1:
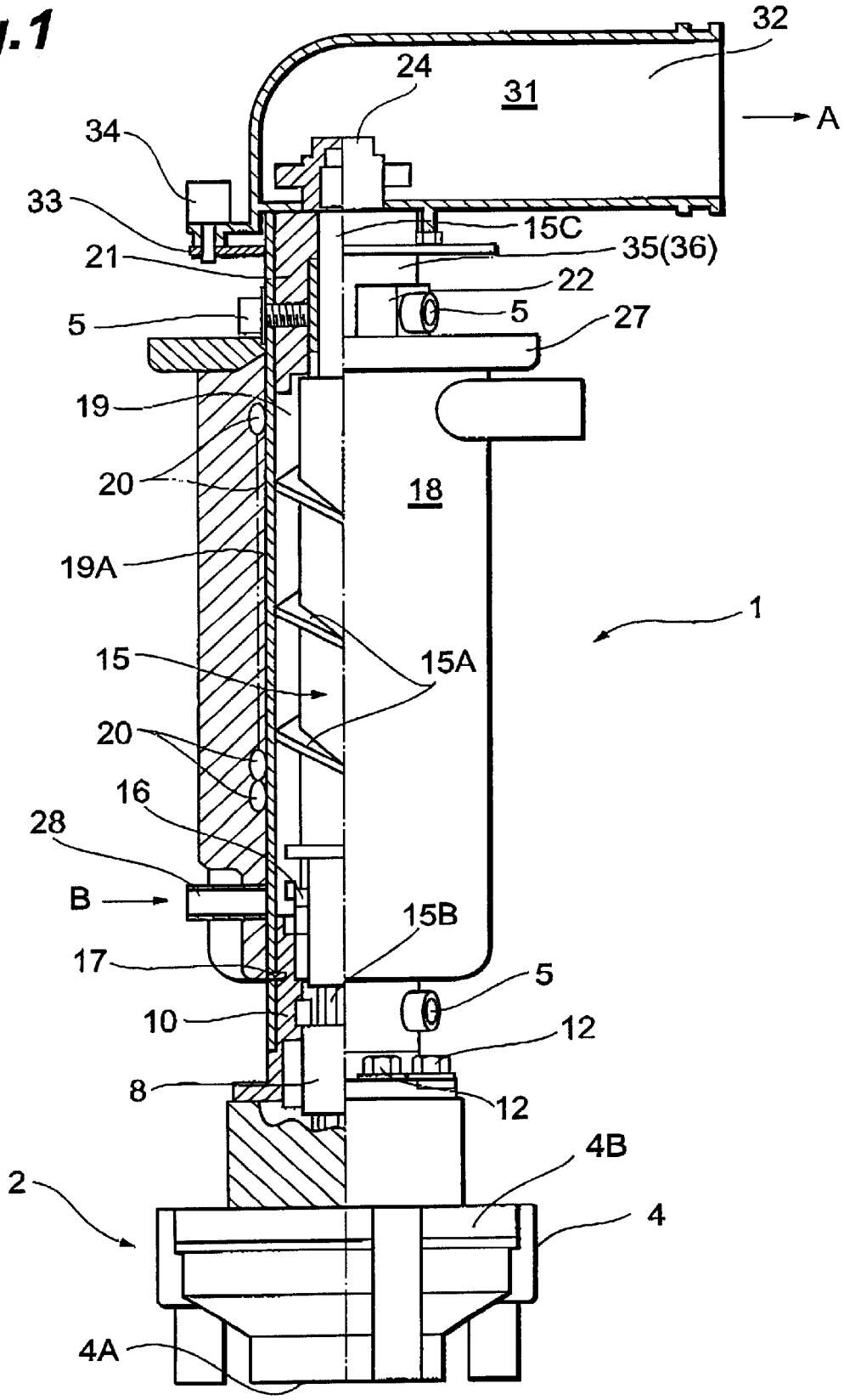
FIG. 1 is a model sectional view of an embodiment of the auger type ice-making machine of the present invention.

Embodiments of the auger type ice-making machine of the present invention will be described below with reference to the attached figures. First, the schematic construction of the auger type ice-making machine of the present embodiments will be described with reference to FIGS. 1 and 2. FIG. 1 is a model sectional view of the auger-type ice-making machine, and FIG. 2 is an exploded perspective view of the auger type ice-making machine.

Figure 2:
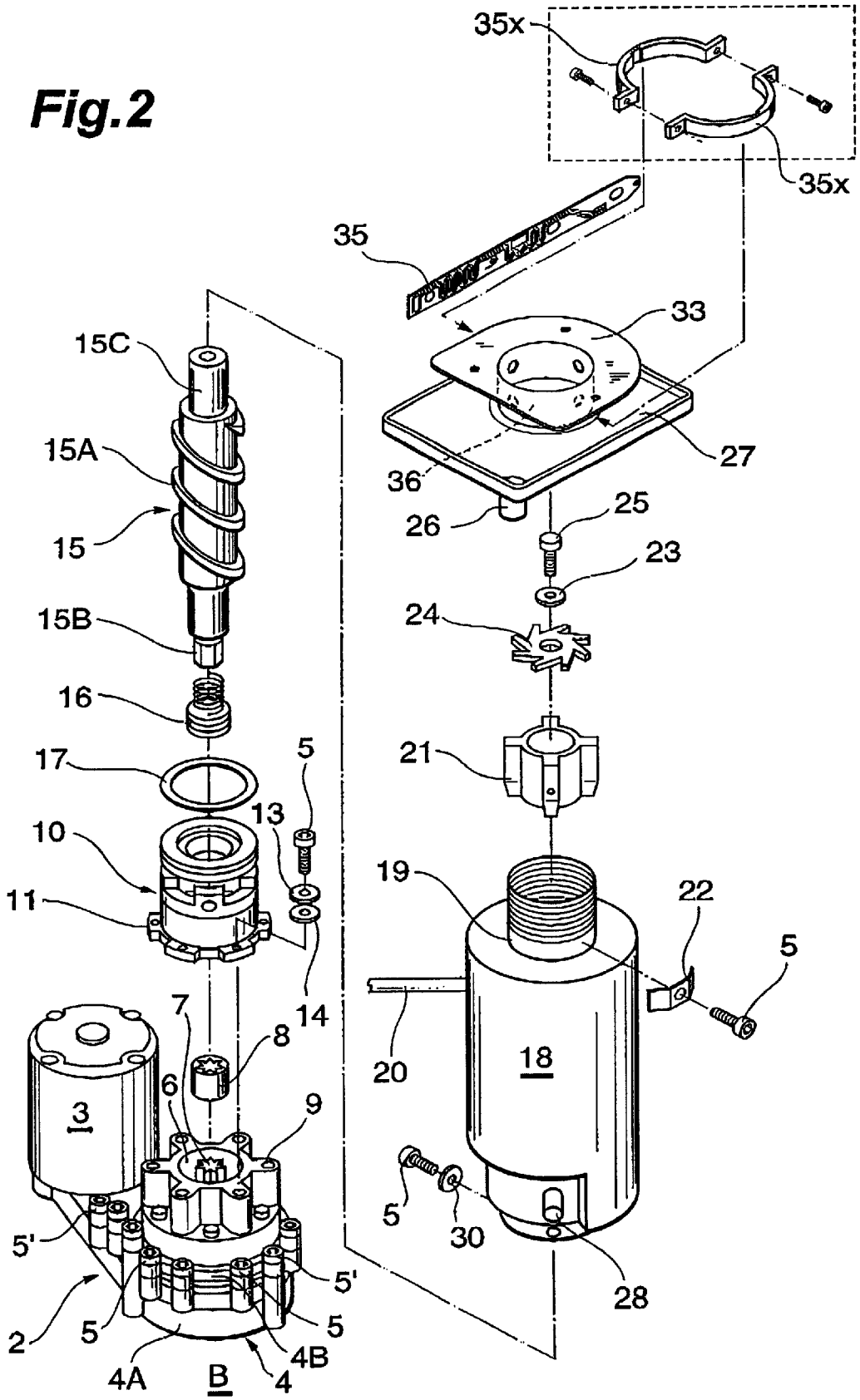
FIG. 2 is an exploded perspective view of an embodiment of the auger type ice-making machine of the present invention.

As is shown in FIGS. 1 and 2, a geared motor 2 is disposed in the lower part of the auger type ice-making machine 1. In this geared motor 2, a driving motor 3 and a speed reduction gear 4 are constructed as an integral unit. The driving motor is driven by single phase 100 V, and a parallel-shaft spur gear three-stage system is used for the speed reduction mechanism installed in the speed reduction gear 4. Furthermore, the speed reduction gear 4 has an aluminum casting lower cover 4A and upper cover 4B, and the lower cover 4A and upper cover 4B are fastened to each other by means of a plurality of hexagonal hole-equipped bolts 5. Furthermore, the geared motor 2 is fastened to the base B (the base used to fasten the auger type ice-making machine 1 in place) by passing long hexagonal hole-equipped bolts 5' through the upper cover 4B and lower cover 4A.

A connecting opening 6 is formed in the upper cover 4B of the speed reduction gear 4, and the output shaft 7 of the speed reduction mechanism faces this connecting opening 6. The lower end of a spline coupling 8 is attached to the output shaft 7, and the upper end of this spline coupling 8 is connected to the lower end of the auger 15 (described later). The flange part 9 of the upper cover 4B that is formed around the connecting opening 6 is superimposed on a flange part 11 that is formed on the lower part of the housing 10, and these flange parts are connected to each other by means of hexagonal hole-equipped bolts 5 and washers 13 and 14 in plurality of locations. Here, the housing 10 is formed from a copper alloy, and bearings made of a resin (not shown in the figures) are press-fitted inside the housing 10. This housing 10 acts to connect and fasten the geared motor 2 and freezer casing 18 to each other.

The auger 15 is made of stainless steel, and has a configuration in which a spiral auger tooth 15A is formed around a cylindrical central part. This auger tooth 15A pushes sorbet-like ice grown inside the freezer casing 18 toward the top of the freezer casing 18 while scraping this sorbet-like ice from the inside walls of the freezer casing 18. Furthermore, the lower end 15B of the auger 15 is connected to the upper end of the spline coupling 8 inside the housing 10. As a result, the auger 15 is slowly rotated via the geared motor 2 (driving motor 3 and speed reduction gear 4) and spline coupling 8, and as this rotation takes place, the ice that is grown inside the freezer casing 18 is pushed upward, while scraping the ice from the inside walls of the freezer casing 18. Furthermore, a mechanical seal 16 is disposed in a position above the lower end 15B of the auger 15; this mechanical seal 16 forms a seal so that there is no leakage of the ice-making water that is supplied to the interior of the freezer casing 18. Moreover, an O-ring 17 is disposed on the circumferential wall of the housing 10.

The freezer casing 18 has a stainless steel ice-making cylinder 19 inside, and a heat-insulating material (foam polyurethane) is disposed on the outside of this ice-making cylinder 19. A copper cooling pipe 20 is wound around the outer circumference of the cylinder wall 19A of the ice-making cylinder 19. This cooling pipe 20 is connected to a universally known freezer unit (consisting of a compressor, condenser and the like). Furthermore, the cooling medium that is introduced into the cooling pipe 20 is evaporated inside the cooling pipe 20 as a result of an abrupt pressure drop; in this case, the cooling medium captures a large quantity of heat of vaporization, so that the temperature inside the ice-making cylinder 19 is abruptly lowered. As a result, the ice-making water on the inside surfaces of the cylinder wall 19A in the ice-making cylinder 19 is frozen. Furthermore, since the construction of the freezer unit is universally known, a detailed description is omitted here.

In an upper position of the freezer casing 18, an ice compression head 21 made of stainless-steel is engaged with the upper end of the the ice-making cylinder 19. And this ice compression head 21 and the upper part of the ice-making cylinder 19 are fastened to each other in a plurality of locations by means of hexagonal hole-equipped bolts 5 via washers 22. Furthermore, bearings (not shown in the figures) made of a resin are mounted inside the ice compression head 21, and the upper end 15C of the auger 15 passed through the interior of the ice-making cylinder 19 is supported on these bearings so that the auger 15 can rotate.

Furthermore, a cutter 24 is fastened to the top of the upper end 15C of the auger 15 by means of a hexagonal bolt 25 via a washer 23. This cutter 24 rotates with the rotation of the auger 15. The ice compression head 21 functions as a fixed blade, so that the sorbet-like ice that is pushed upward through the interior of the ice-making cylinder 19 while being scraped from the interior walls of the ice-making cylinder 19 by the auger 15 is compressed into cylindrical ice by the ice compression head 21. The compressed cylindrical ice is further lifted, and is cut by the cutter 24 to form chip-form or flake-form ice. The chip-form or flake-form ice thus produced is discharged from the ice discharging part 31 in the direction indicated by the arrow A.

An ice discharge tube 32 made of a resin, which regulates the discharge direction of the ice that has been finely cut by the cutter 24, is attached to the ice discharging part 31. This ice discharge tube 32 is attached to the upper end or the ice-making cylinder 19 using a flange 33 that is attached to the upper part of the ice-making cylinder 19 as an attachment base. The flange 33 is a plate-form member that is perpendicular to the central axis of the ice-making cylinder 19; the ice discharge tube 32 is fastened to this part via nuts 34. Furthermore, a belt heater 35 is wrapped around the outside of the part where the ice compression head 21 is fastened inside the ice-making cylinder 19. This belt heater 35 warms the area around the ice compression head 21 and slightly melts the surface of the compressed ice, so that discharge of the ice can be accomplished in a smooth manner.

Figure 3:
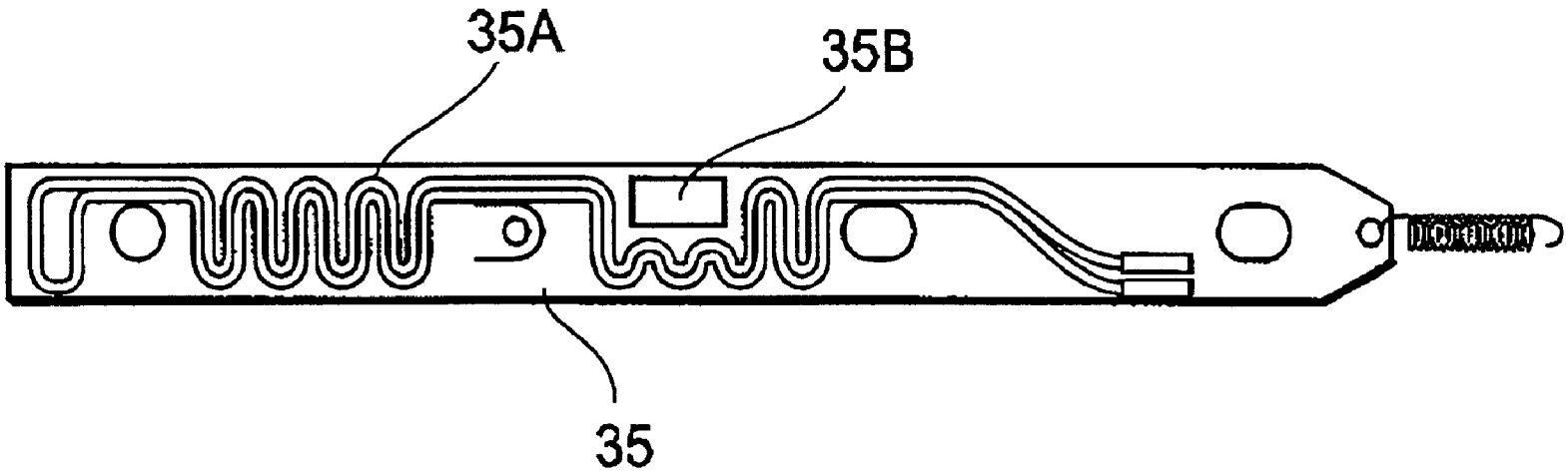
FIG. 3 is an interior view of the belt heater.
Figure 4:
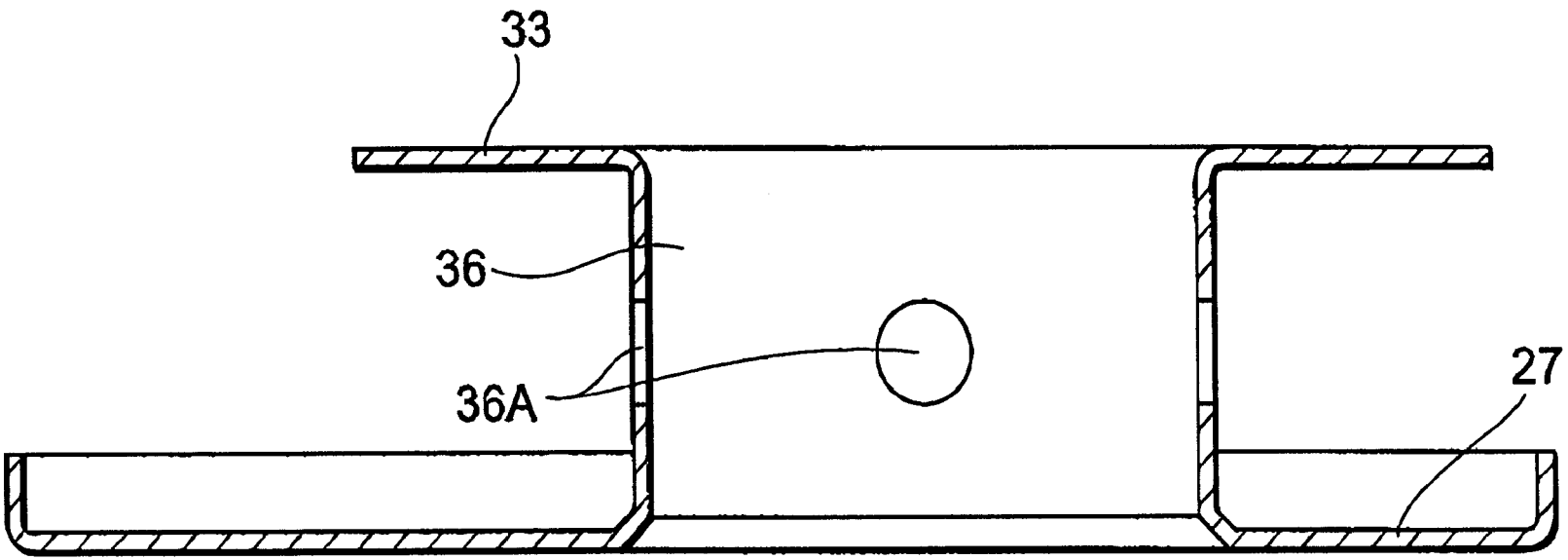
FIG. 4 is a sectional view of the flange, outer cylinder and dew receiving dish.

FIG. 3 shows an inner view of the belt heater 35. The belt heater 35 is formed by molding electrical heating wires 35A inside a belt-form silicone material. The heat generated by the electrical heating wires 35A is controlled by electric power that is supplied from a control part not shown in the figures. The belt heater 35 also has a thermostat 35B inside, thus forming a mechanism in which the generation of heat is stopped when the temperature rises to a specified temperature. It would also be possible to install a temperature sensor instead of the thermostat 35B, and to control the generation of heat by the belt heater 35 on the basis of the detection results of this temperature sensor.

Furthermore, it would also be possible to use an aluminum casting heater 35X as shown at the upper right of FIG. 2 instead of the belt heater 35. In the case of such an aluminum casting heater 35X, a sheath heater or cartridge heater is formed by casting in accordance with the shape of the object of heating, using an aluminum material that is superior in terms of thermal conductivity. The generation of heat by this heater is controlled by electric power supplied from a control part not shown in the figures. Such an aluminum casting heater is constructed as a pair of parts, and both of these parts are fastened together by hexagonal hole-equipped bolts A thermostat is mounted on the outside surface of the aluminum casting heater 35X, so that the temperature of the heat generation of this heater is controlled.

Furthermore, a dew receiving dish 27 which has a drainage pipe 26 formed as an integral part is disposed on the upper part of the freezer casing 18. This dew receiving dish 27 captures the condensed water that condenses in the vicinity of the hexagonal hole-equipped bolts 5, and discharges the captured condensed water via the drainage pipe 26. Moreover, a water inlet port 28 that communicates with the interior of the ice-making cylinder 19 is formed in the lower part of the freezer casing 18. A universally known ice-making water supply tank is connected to this water inlet port 28, and ice-making water that is supplied to the interior of the ice-making cylinder 19 from the water inlet port 28 in the direction indicated by the arrow B is made into ice inside the ice-making cylinder 19. Furthermore, the housing 10 is disposed inside the ice-making cylinder 19 in a lower position of the freezer casing 18, and the lower part of the freezer casing 18 and the housing 10 are connected and fastened together in a plurality of locations by hexagonal hole-equipped bolts 5 via washers 30.

Furthermore, in the present embodiment, the abovementioned flange 33 is fastened to the ice-making cylinder 19 by a common fastening using the hexagonal hole-equipped bolts 5 used to fasten the ice compression head 21. Moreover, the flange 33 has an outer cylinder 36 that is passed through the ice-making cylinder 19 (the flange 33 and outer cylinder 36 are formed as an integral unit). The flange 33 is fastened to the ice-making cylinder 19 as a result of this outer cylinder 36 being fastened to the ice-making cylinder by hexagonal hole-equipped bolts 5. Furthermore, the abovementioned dew receiving dish 27 is also formed as an integral unit with this outer cylinder 36, so that the dew receiving dish 27 is also fastened to the ice-making cylinder 19 as a result of the outer cylinder 36 being fastened to the ice-making cylinder 19.

Furthermore, the outer cylinder 36 is constructed from copper, which is a metal with a good thermal conductivity, and the abovementioned belt heater is wrapped around and fastened to the outer circumferential surface of the outer cylinder 36. Specifically, the outer cylinder 36 is disposed between the ice-making cylinder 19 and the belt heater 35. In addition to copper, other examples of metals with a good thermal conductivity include copper alloys (alloys consisting chiefly of copper), as well as gold, silver, aluminum and alloys consisting chiefly of these metals. The flange 33 and condensation receiving dish 27 are made of stainless steel, and are joined to the copper outer cylinder 36 as integral parts by welding or brazing.

The abovementioned belt heater 35 is wrapped around the outside surface of the copper outer cylinder 36, and is fastened in place by means of washers 22 and hexagonal hole-equipped bolts 5. In this case, the outer cylinder 36 is also fastened to the ice-making cylinder 19 by means of these washers 22 and hexagonal hole-equipped bolts 5. Through-holes 36A for the insertion of the hexagonal hole-equipped bolts 5 are formed in the outer cylinder 36.

Here, the flange 33 and dew receiving dish 27 are also formed as integral parts of the outer cylinder 36; accordingly, these parts are also fastened to the ice-making cylinder 19 by means of the abovementioned washers 22 and hexagonal hole-equipped bolts 5. Specifically, the outer cylinder 36, flange 33, dew receiving dish 27 and belt heater 35 are all fastened at the same time using the washers 22 and hexagonal hole-equipped bolts 5 used for the fastening of the ice compression head 21.

In the present embodiment, since the flange 33 (outer cylinder 36) is also fastened using the hexagonal hole-equipped bolts 5 used for the fastening of the ice compression head 21, the installation of the flange 33 can be simplified. Here, furthermore, if the dew receiving dish 27 is also integrated with the flange 33 via the outer cylinder 36, these members can all be fastened at one time, which is convenient. In particular, the flange 33 (along with the dew receiving dish 27) is commonly fastened to the ice-making cylinder 19 by welding in the case of conventional techniques, however, the portion of the ice-making cylinder 19 in the vicinity of the ice compression head 21, to which these members are fastened, is a location where a slight expansion and contraction are repeated, so that stress fluctuations are generated. Accordingly, this was a location where there was a danger that parts would fall off as a result of stripping of the welded portions or the like.

Furthermore, because a slight strain was sometimes generated in the ice-making cylinder 19 by welding or brazing of the flange 33 or dew receiving dish 27, such welding or brazing was not very desirable from the standpoints of attachment of the internal ice compression head 21 or rotation of the auger 15. If the flange 33 is fastened to the ice-making cylinder 19 using hexagonal hole-equipped bolts 5 as in the present embodiment, then such an inconvenience is eliminated, and bothersome welding or brazing processes can be omitted. Furthermore, because the bolts used for the fastening of the ice compression head 21 are used as the hexagonal hole-equipped bolts 5 that are utilized in this case, there is no increase in the complexity of the structure, and no increase in the number of parts required.

Figure 5:
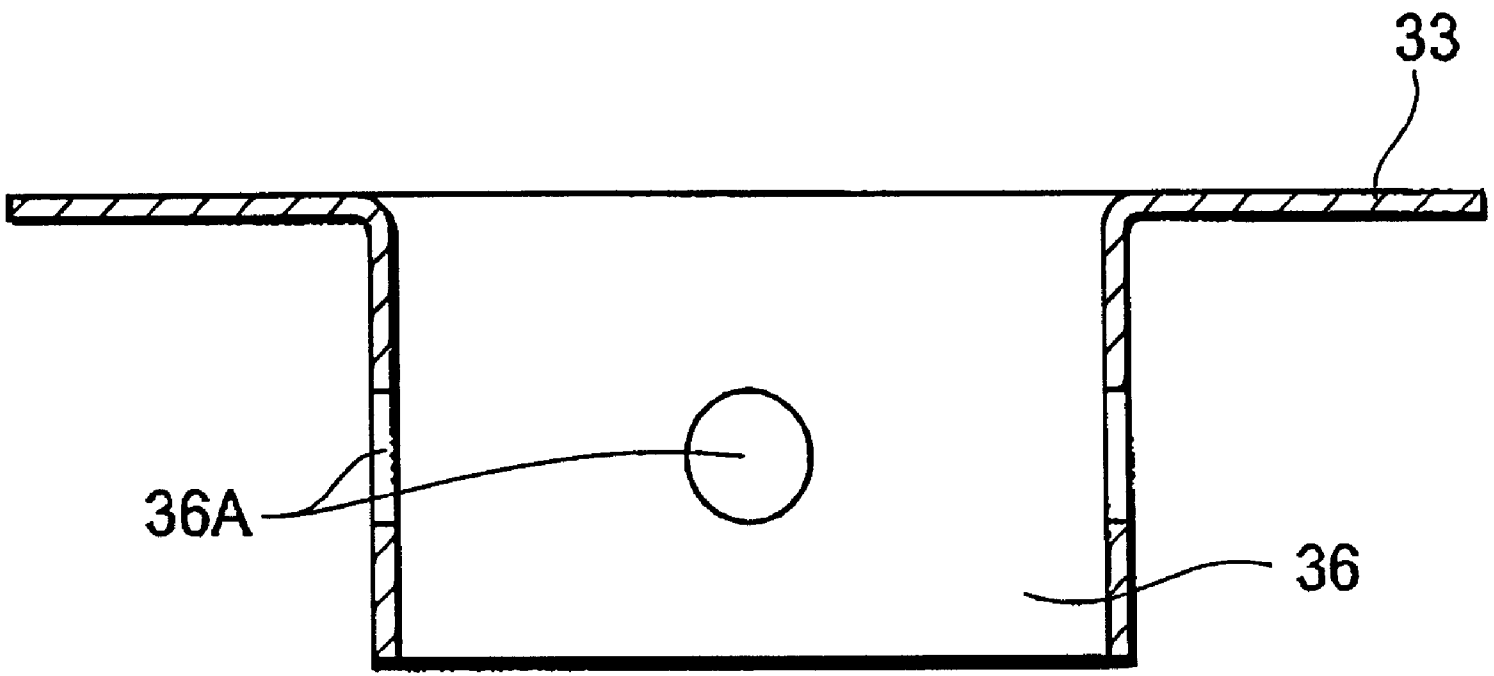
FIG. 5 is a sectional view of the flange and outer cylinder (Modification 1)
Figure 6:
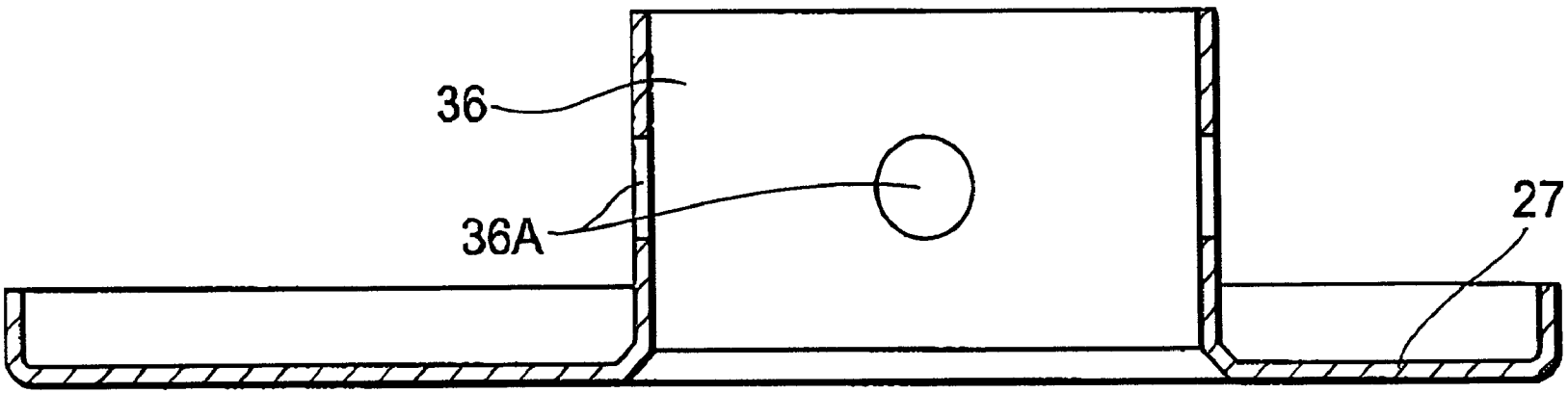
FIG. 6 is a sectional view of the outer cylinder and dew receiving dish (Modification 2)

Furthermore, in the present embodiment, the dew receiving dish 27 is also integrated with the flange 33 via the outer cylinder 36; however, as is shown in FIG. 5, it is not necessary to integrate the dew receiving dish 27 (it would also be possible to integrate only the flange 33 and the outer cylinder 36). In this case, the dew dish 27 is fastened to the freezer casing 18 by some other method (for example, a conventional method). Alternatively, it would also be possible to integrate only the dew receiving dish 27 with the outer cylinder 36 consisting of a metal with a good thermal conductivity, as shown in FIG. 6. In this case, the flange 33 is formed in a configuration as shown in FIGS. 7 through 11 mentioned later, and is fastened by means of hexagonal hole-equipped bolts 5 together with the parts shown in FIG. 6.

Furthermore, as was described above, as a metal with a good thermal conductivity (the copper outer cylinder 36 in the case of the present embodiment) is interposed between the ice-making cylinder 19 and the belt heater 35, the heat generated by the belt heater can be uniformly diffused over a broad range by this metal with a good thermal conductivity (outer cylinder 36). Furthermore, the heat that is thus evened out by the metal with a good thermal conductivity (outer cylinder 36) is transmitted to the ice-making cylinder 19 on the inside. As a result, the vicinity of the ice compression head 21 in the ice-making cylinder 19 can be uniformly heated, so that the discharge of the compressed ice can be accomplished in a smooth manner. Furthermore, since the metal with a good thermal conductivity (i. e., the outer cylinder 36) transmits heat quickly, this system is also advantageous in that the control of the heat generated by the belt heater 35 is quickly reflected.

In the example described above, the flange 33 had an outer cylinder 36 (the flange 33 and outer cylinder 36 were integrated). However, from the standpoint of the fastening of the flange 33, it would also be possible to omit a cylindrical part such as the outer cylinder 36 in the fastening of the flange 33 to the ice-making cylinder 19. Furthermore, even if the flange 33 does not have a cylindrical portion, it would be possible to install an outer cylinder 36 with a good thermal conductivity as well.

Figure 7:
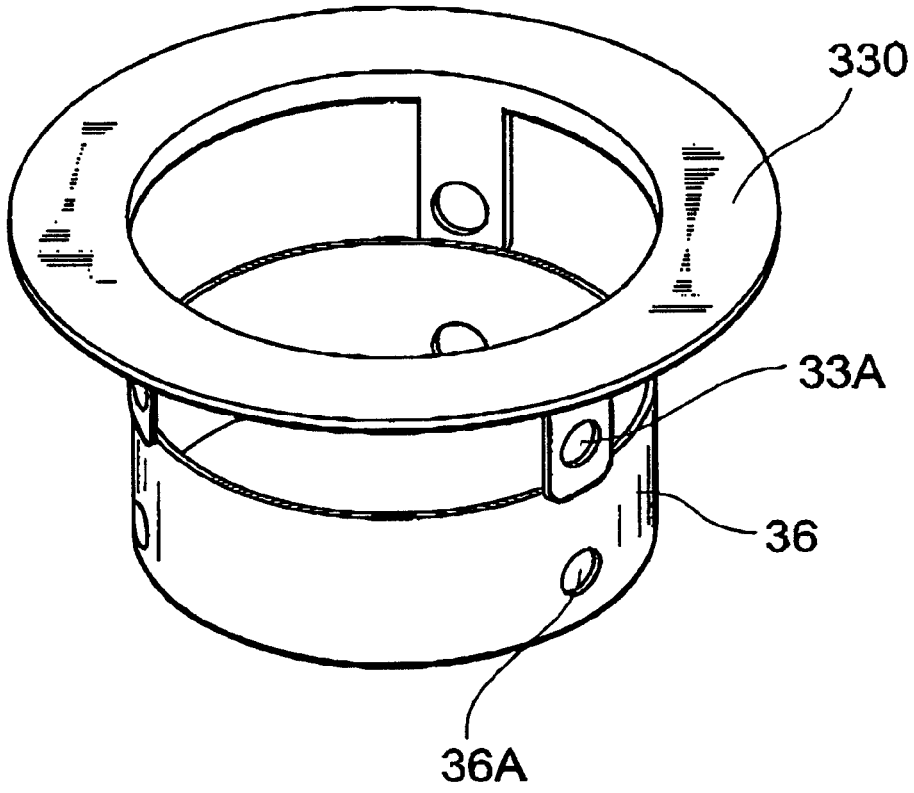
FIG. 7 is an exploded perspective view which shows another example of the flange and outer cylinder.
Figure 8:
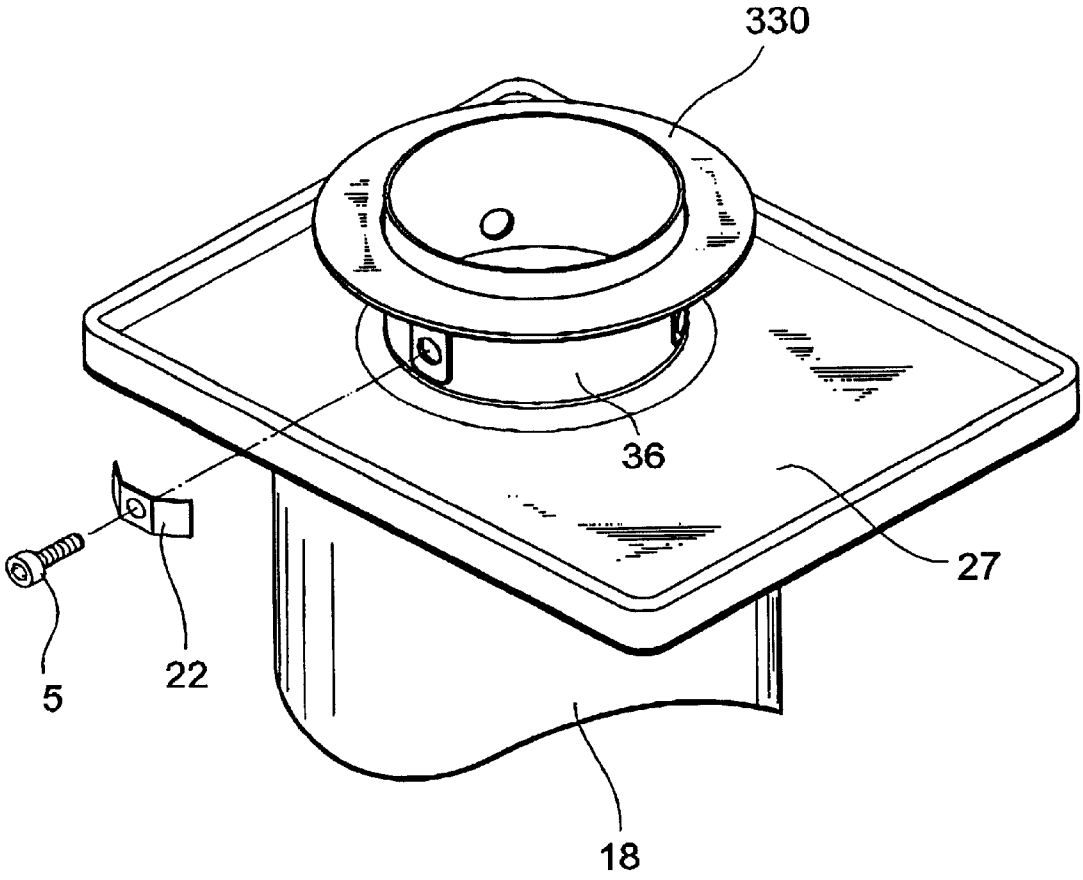
FIG. 8 is a perspective view which shows another example of the flange and outer cylinder.
Figure 9A:
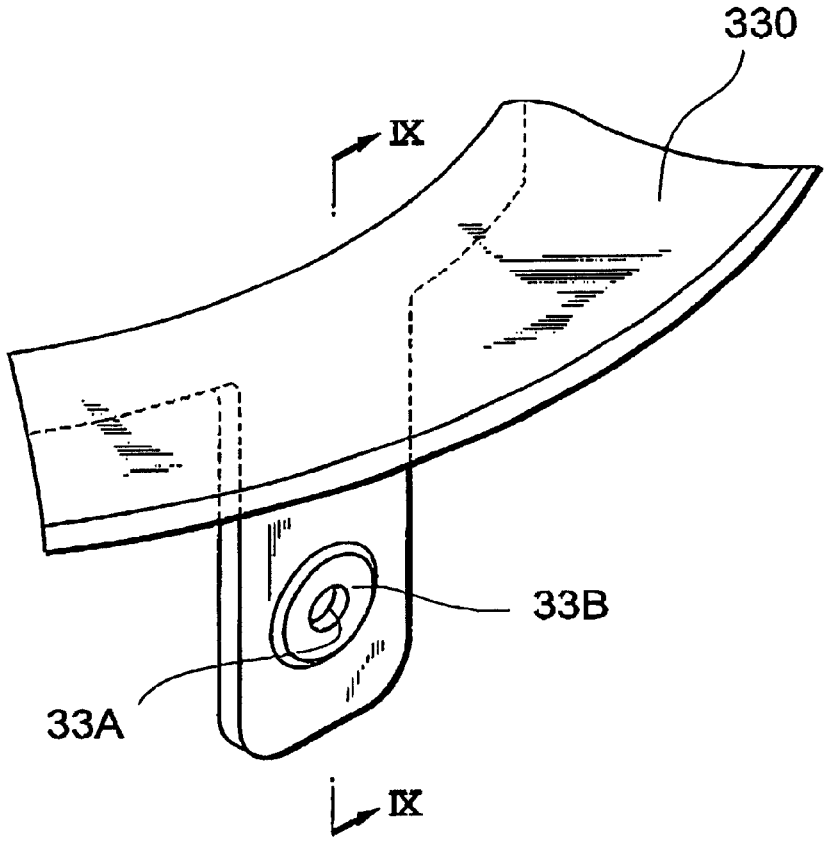
FIG. 9A shows a partial perspective view of the area in the vicinity of the flange attachment part.
Figure 9B:
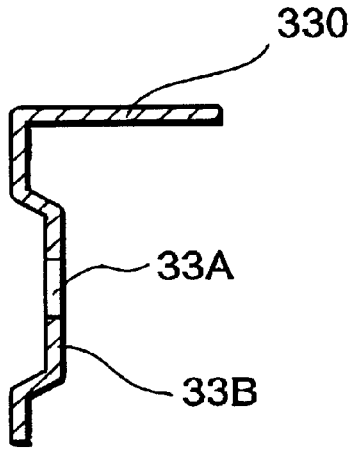
FIG. 9B shows a sectional view along line IX—IX in FIG. 9A.

Such an example is shown in FIGS. 7 and 8. A copper outer cylinder 36 formed in the shape of a simple cylinder, and a flange 330 which has bolt through-holes 33A, are shown in FIG. 7. The flange 330 has portions that contact the outer surface of the outer cylinder 36, and through-holes 33A for hexagonal hole-equipped bolts 5 that fasten the ice compression head 21 are formed in these portions. As is shown in FIG. 8, the flange 330 shown in FIG. 7 is fastened in common with the outer cylinder 36 by washers 22 and hexagonal hole-equipped bolts 5. Furthermore, if protruding parts 33B such as those shown in FIGS. 9A and 9B are formed around the peripheries of the through-holes 33A in the flange 330, then these parts have the same function as washers, so that the washers 22 may be omitted. The protruding parts 33B cause the peripheries of the through-holes 33A to protrude slightly to the outside.

In this case, the belt heater 35 is also fastened in common; however, portions of the belt heater 35 contact the portions of the flange 330 where the through-holes 33A are formed, and do not directly contact the outer cylinder 36. Nevertheless, the heat generated by the belt heater 35 is transmitted to the outer cylinder 36 via the portions where the through-holes 33A are formed. Furthermore, since the heat that is transmitted to the outer cylinder 36 consisting of a metal with a good thermal conductivity is diffused and evened out, an effect similar to that obtained in the case illustrate in FIG. 2 above can be achieved.

Thus, in a case where the outer cylinder 36 and flange are constructed from different materials, there is no need to integrate these parts by welding or brazing, so that the installation and fastening of the respective parts can be accomplished in a simple manner. Furthermore, the flange was described here; however, a similar procedure can also be used in the case of the dew receiving dish 27. In the case of the dew receiving dish 27, however, it is necessary to seal the boundary part with the freezer casing 18 (ice-making cylinder 19) because of role that the dew receiving dish 27 plays in capturing condensed water.

Figure 10:
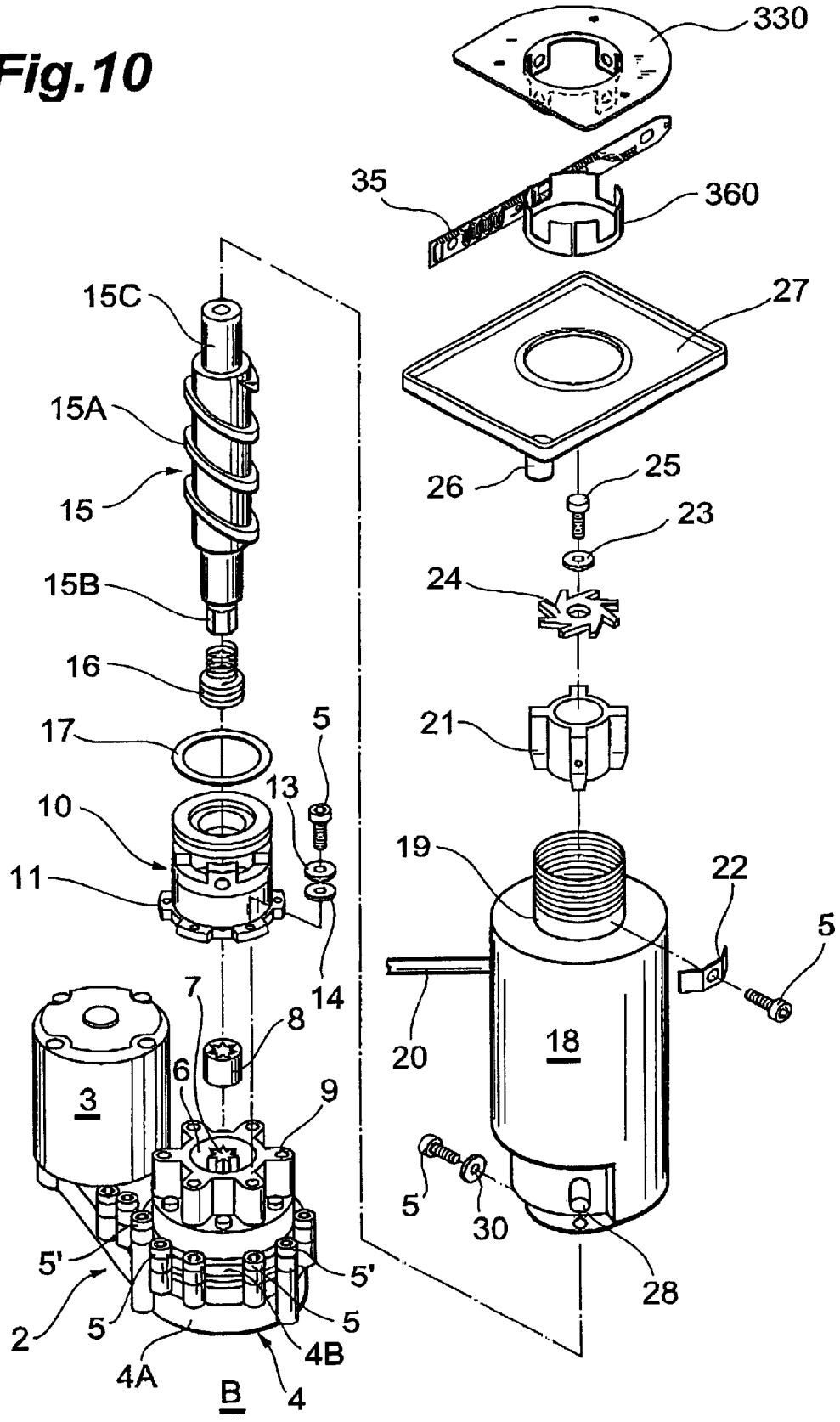
FIG. 10 is an exploded perspective view of another embodiment of the auger type ice-making machine of the present invention.
Figure 11:
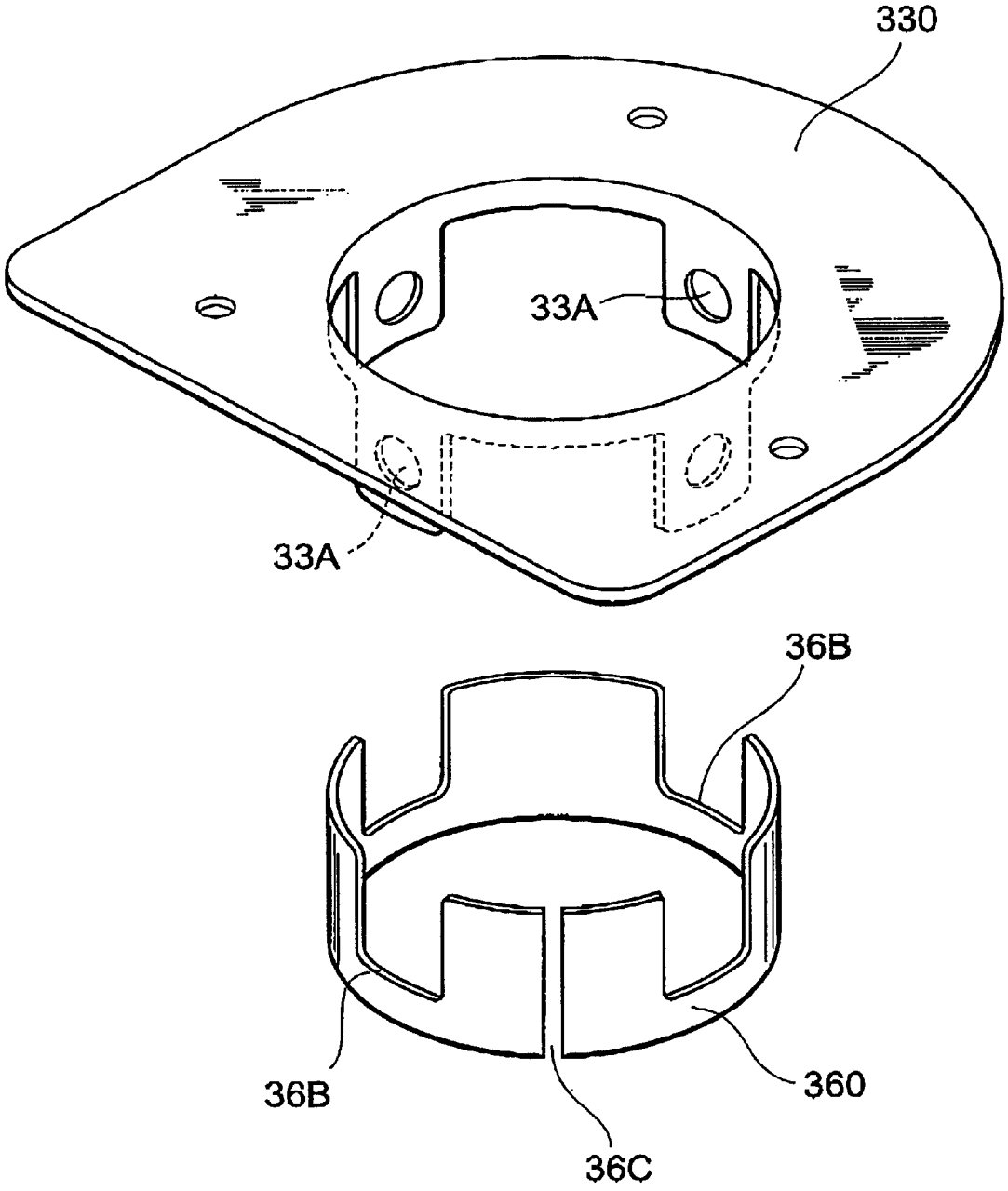
FIG. 11 is a perspective view of the flange and outer cylinder.

Next, another embodiment of the auger type ice-making machine of the present invention will be described. An exploded perspective view of this embodiment corresponding to FIG. 2. of the abovementioned embodiment is shown in FIG. 10. In this embodiment, the fastening of the flange 330 to the ice-making cylinder 19 is more or less similar to that in the case of FIGS. 7 and 8 above. However, the shape of the outer cylinder 360 differs from the example shown in FIGS. 7 and 8. In the present embodiment, the outer cylinder 360 is not fastened in common by means of the hexagonal hole-equipped bolts 5 that fasten the ice compression head 21. This will be described in greater detail below; however, parts that are identical or equivalent to parts in the embodiment shown in FIGS. 1 and 2 will be labeled with the same symbols, and a detailed description of these parts will be omitted.

The flange 330 of the present embodiment has a shape that is more or less similar to that of the flange 330 shown in FIGS. 7 and 8 above, and has portions that are fastened in common with the hexagonal hole-equipped bolts that fasten the ice compression head 21. Through-holes 33A through which the hexagonal hole-equipped bolts 5 are passed are formed in these portions. Furthermore, the outer cylinder 360 in this embodiment is formed in a configuration that has cut-out parts 36B that correspond to the through-holes 33A of the abovementioned flange 330. Moreover, this outer cylinder 360 is formed by bending a single copper plate into a tubular shape, so that the manufacture is easy. Accordingly, the outer cylinder 360 in this embodiment has a slit 36C.

The inner diameter of the flange 330, the inner diameter of the outer cylinder 360 and the outer diameter of the ice-making cylinder 19 are more or less equal. Since the shapes of the indentations and projections in the flange 330 and the shapes of the indentations and projections in the outer cylinder 360 agree, both parts are inserted into the ice-making cylinder 19 in a state in which these shapes are fit together. Then, the belt heater 35 is wrapped around the circumference, and finally, fastening is performed from above using the washers 22 and hexagonal hole-equipped bolts 5 that fasten the ice compression head 21. The outer cylinder 360 is not directly fastened by the hexagonal hole-equipped bolts 5, but is fastened via the washers 22 and belt heater 35.

The flange 330 (and outer cylinder 360) can also be fastened in this manner. Furthermore, the heat of the belt heater 35 can also be diffused and evened out, so that the discharge of the ice can be accomplished more smoothly, by thus interposing a metal with a good thermal conductivity (outer cylinder 360) between the belt heater 35 and ice-making cylinder 19. Moreover, through-holes through which the hexagonal hole-equipped bolts 5 are passed are also formed in the belt heater 35. In the immediate vicinity of these holes, since there is a danger of breakage, there is little installation of electrical heating wires 35. Furthermore, even if electrical heating wires 35A are installed in these areas, the area in the vicinity of the through-holes 33A of the flange 330 is small. Accordingly, even if a metal with a good thermal conductivity is not installed in the vicinity of the through-holes 33*a* of the flange 330, this lack of installation has little effect.

Furthermore, the present invention is not limited to the respective embodiments; various improvements and modifications are possible without departing from the spirit of the present invention. For example, in the abovementioned embodiments, a case was described in which the ice compression head was fastened by means of washers and bolts after the belt heater was wrapped. However, a structure in which the belt heater is attached last may also be used. Furthermore, in the example shown in FIGS. 7 and 8, a case was described in which the belt heater was wrapped from above the attachment part of the flange. However, it would also be possible to superimpose these parts from the inside in the order metal with good thermal conductivity—belt heater—the attachment part of the flange.

In the present invention, the flange that acts as the attachment base for the ice discharge tube is fastened in common using the bolts that are used to fasten the ice compression head. Accordingly, the flange can be fastened easily and securely to the ice-making cylinder. In this case, since the bolts used for the fastening of the ice compression head are utilized, there is no increase in the manufacturing steps required for the ice-making machine, and no complication of the structure. Furthermore, since no welding or the like is performed, there is no need for concern about parts falling off or the like, and since removal is easy, maintenance is facilitated.

Furthermore, the ice discharge tube that regulates the ice discharge direction is fastened to the flange. Furthermore, this flange is fastened in common by means of the bolts used to fasten the ice compression head. A structure in which the ice discharge tube is directly fastened in common by means of the bolts used to fasten the ice compression head without using such a flange is also conceivable (Japanese Patent Application Laid-Open No. S 59-18363). In such a case, however, the positions of the holes used for insertion of the bolts of the ice compression head are difficult to confirm because of interference by the ice discharge port when the ice compression head is disposed inside the freezer casing and fastened by means of the bolts. In the case of the present invention, on the other hand, no such problem arises, and the confirmation is easy.

Furthermore, the ice discharge tube is pressed by the discharged ice and easily deformed, so that frequent replacement of this ice discharge tube is necessary. Accordingly, a configuration in which the discharge tube is fastened to the flange is commonly used. However, if the ice discharge tube is thus directly fastened in common by means of the bolts used to fasten the ice compression head, it is necessary to remove the ice compression head as well when the ice discharge tube is replaced. In the present invention, however, a structure is used in which the ice discharge tube is fastened to the flange; accordingly, no such problem arises, and maintenance can easily be performed.

In the invention described in claim 2, the flange has an outer cylinder, and a dew receiving dish is connected to this outer cylinder. Accordingly, both the flange and the dew receiving dish can be simply and securely fastened (common fastening by means of bolts) to the ice-making cylinder via the outer cylinder. If this is done, an similar effect can be obtained not only in regard to the flange, but also in regard to the fastening of the dew receiving dish.

What is claimed is:

1. An auger type ice-making machine comprising:

a tubular freezer casing which has an ice-making cylinder that rotatably accommodates an auger inside;

an ice compression head which rotatably supports the upper end of said auger, and which is disposed on the upper part of said freezer casing;

a housing which rotatably supports the lower end of said auger, and which is disposed under the lower part of said freezer casing;

a geared motor which is connected to the lower part of said housing, and which drives said auger rotational ly; and a flange constituting an attachment base for an ice discharge tube that is attached to the upper part of said freezer casing;

wherein said flange is fastened to said ice-making cylinder by means of bolts that also fasten said ice compression head to the interior of said ice-making cylinder.

2. The auger type ice-making machine according to claim 1, wherein said flange comprises an outer cylinder in which through-holes for said bolts are formed, and a dew receiving dish that captures condensed water condensing in the vicinity of said bolts is connected to said outer cylinder.

* * * * *